United States Patent [19]

LeVasseur

[11] 4,055,174

[45] Oct. 25, 1977

[54] SWIMMING SYSTEM

[76] Inventor: Kenneth W. LeVasseur, 1129 Ala Moana Bl., Honolulu, Hawaii 96814

[21] Appl. No.: 643,163

[22] Filed: Dec. 22, 1975

Related U.S. Application Data

[62] Division of Ser. No. 471,545, May 20, 1974, Pat. No. 3,934,290.

[51] Int. Cl.[2] ..... A62B 7/00

[52] U.S. Cl. ..... 128/142.5; 128/145 A; 2/2.1 R; 9/331

[58] Field of Search ..... 128/145 A, 145 R, 141 R, 128/142, 142.2, 142.3, 142.5, 142.7, 146, 203, 204; 2/2.1 R; 9/329, 330, 331, 332, 308, 309; 61/70 R

[56] References Cited

U.S. PATENT DOCUMENTS

| | | | |
|---|---|---|---|
| 1,049,448 | 1/1913 | Case | 9/308 |
| 1,221,950 | 4/1917 | Zawadzki | 9/309 |
| 2,388,674 | 11/1945 | Browne | 2/2.1 R |
| 2,570,019 | 10/1951 | Nolk | 2/2.1 R |
| 2,851,707 | 9/1958 | Samuels | 128/142.5 |
| 3,344,449 | 10/1967 | Grilli | 9/309 |
| 3,396,949 | 8/1968 | Tsarnas | 2/2.1 R |
| 3,433,222 | 3/1969 | Pinto | 128/142.2 |
| 3,493,972 | 2/1970 | Oldham | 2/2.1 R |

FOREIGN PATENT DOCUMENTS

| | | | |
|---|---|---|---|
| 1,315,112 | 5/1970 | United Kingdom | 128/142.5 |

*Primary Examiner*—Robert W. Michell

*Assistant Examiner*—Henry J. Recla

*Attorney, Agent, or Firm*—James C. Wray

[57] ABSTRACT

A swimming system for maximum efficiency in water has a single foot fin with a large fluke and two foot openings leading to foot pockets separated by a cushion. A series of water directed openings extend rearward and outward from a line above the toe portions of the pockets diagonally through the fluke to a line near a tip of the fluke on a rearward portion of the fin. A fastening surrounds the fin near instep areas of the foot-receiving pockets. A leg sheath has a corresponding lower fastening, a cushioning divider between legs and an achilles cushion above a heel portion to streamline the sheath. A reinforced upper waist band fastens to a jacket portion with hand openings which overlie hand fins formed of flat circular plates with finger and palm cutouts mounted between two pieces of synthetic dolphin skin. The helmet with an annular neck encircling cushion completes the streamlined entire body covering with a synthetic dolphin skin exterior. A blow-hole rearward of a neck portion of the helmet has a raised forward edge to promote air entrapment in a snorkle which leads through the annular cushion to a mouthpiece. A watertight snap seal covers a forward opening in the mouthpiece. Nostril blocks are provided in a nose cavity. Eyes are encircled by seals which support curved lens for removing water distance distortions. Tubes lead from eye areas to the mouthpiece for pressure equalization. Screened ear holes permit pressure equalization and hearing.

12 Claims, 15 Drawing Figures

Front
figure 1
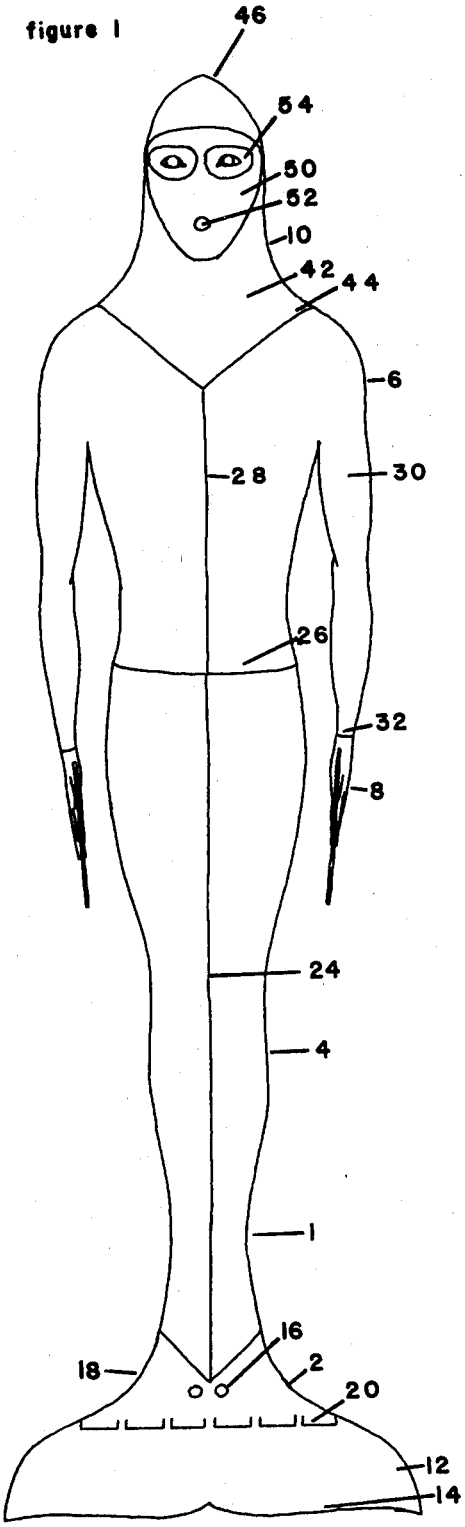
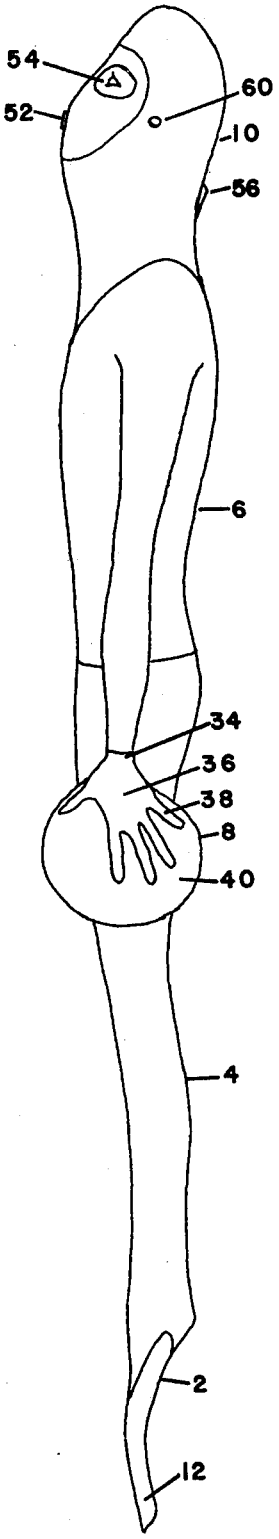
Figure 2
Side
Rear
figure 3
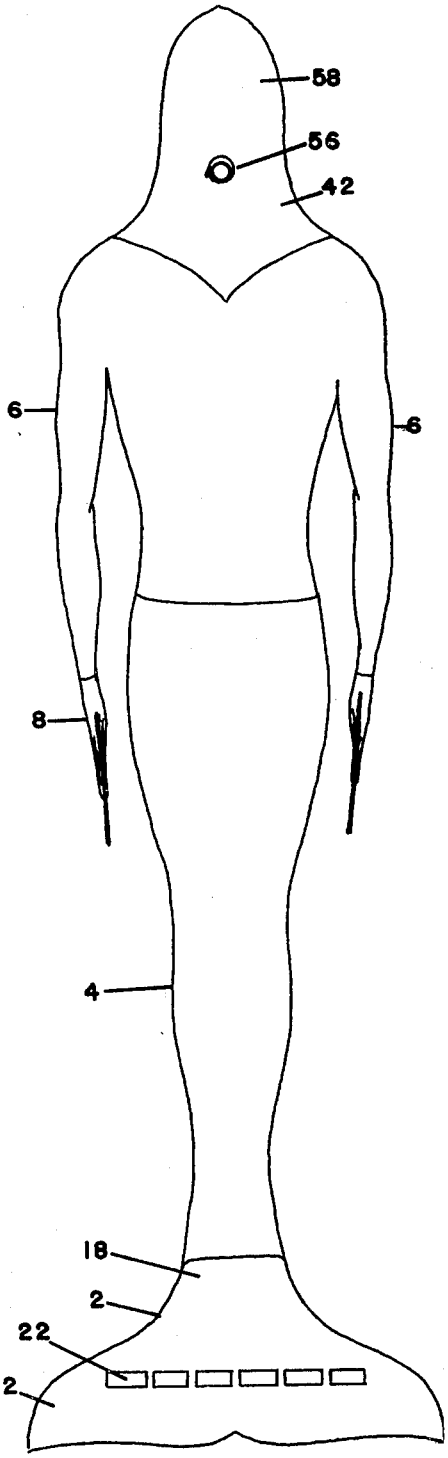

46
120
122
124
60
118
10
56
52
42
102
100
110
112
112
56
104

104
108
110
56
114

42
116
54
118
52
104
10
106
42
42
102
100

110
108
56
104
104

84
88

86
40
90
8
38
36

98
96
94

64
62
66
18
70
16
2
20

14
2
20
66
68
22

18
70
2

76
74
78
80
82
2
72

4

SWIMMING SYSTEM

This is a division of application Ser. No. 471,545, filed May 20, 1974, now U.S. Pat. No. 3,934,290.

BACKGROUND OF THE INVENTION

In many ways man has tried to increase efficiency in self-propelled movement through water. Several types of apparatus have been devised in attempts to aid efficiency of movement. Special strokes have been developed to further promote efficiency.

A need remains to provide a unitary streamlined swimming apparatus for achieving optimum efficiency in self-propelled movement through the water.

PRIOR ART

A collection of prior art devices disclosed in U.S. patents found in class 9, boats and aquatic devices, particularly swimming devices in subclasses 301–309; and respirators and masks in class 128, subclasses 141, 142.4, 142.5 and 142.7 of the official U.S. Patent Office Classification of Inventions. Examples of the most pertinent patents which are found in those classifications are U.S. Pat. Nos. 2,693,180; 3,165,764; 3,344,449; 1,530,560; 3,428,980; 2,851,707; 3,286,287; 243,834; 1,675,372; 2,313,979 and 1,049,448.

Substantially all of the related body covering swimming aid suits which we uncovered were selected in a preexamination search conducted by the applicant's attorney. None suggests the construction of the present invention.

U.S. Pat. No. 3,344,449 describes a lower body tube tightly fitting over legs in a mermaid-type arrangement with a single fluke which is detachable from the leg covering. The fluke is not constructed in the present manner. There are no boot portions, and there is no central foot separation. The lower body does not have a central leg separation.

A central leg separation is found in U.S. Pat. No. 1,530,560 but that separation is primarily functional in the operation of the device rather than as a soft cushion-like separation for tightly held legs, as in the present invention.

The upper torso-portion of the suit described in U.S. Pat. Nos. 2,851,707 and 3,428,980 are of interest for their streamline shaping. However, the construction of those upper portions is not similar to the construction of the present suit and helmet.

In U.S. Pat. No. 3,428,980 the inventor indicates the necessity of hip mounted fins to work against the feet in dolphin kicks.

U.S. Pat. Nos. 3,286,287; 243,834; and 1,675,372 are examples of other swimming aid body suits.

U.S. Pat. No. 2,313,979 was selected to show a rigid hand mounted swimming fin. U.S. Pat. No. 1,049,448 was selected to show a webbed glove-type of swimming appliance.

The interconnection between fins in U.S. Pat. No. 3,165,764 was selected as a matter of interest.

No reference was found showing a suit with dolphin-like skin or suit having a built in snorkel with tubes extending within a neck surrounding cushion. No reference suggest eye pressure equalization from a mouthpiece. No reference suggests intermediately cushioned legs in a sheath with an achilles cushion. No references suggest a leg sheath which surrounds and grips heels of foot fins.

OBJECTS OF THE INVENTION

One object of the invention is the provision of a swimming apparatus having a body covering skin formed of a wetable material which forms a slick lubricating layer over the surface of the entire body.

Another object of the invention is the provision of a unitary swimming apparatus having a head to toe to finger tip covering in a tight unitary streamlined manner for promoting water propulsion efficiency.

Another object of the invention is the provision of a foot fin having a broad fluke opposite two parallel foot-receiving pockets having a cushion separation.

Another object of the invention is the provision of a foot fin having a broad fluke with a plurality of traverse conduits diagonally leading from a line openings above a toe-holding portion rearwardly and outwardly to opening closer to an edge of the fluke remote from foot-receiving pockets.

Another object of the invention is the provision of a foot fin having a relatively greatly laterally extended fluke, and having foot pockets and fastening means on an exterior of the fin generally lying over a foot instep area of foot-receiving pockets.

Another object of the invention is the provision of a leg sheath for connecting to the foot fluke fin. The leg sheath being made of a slick synthetic dolphin skin and having longitudinal opening means for inserting legs, and having a leg divider centrally positioned in the sheath for cushioning and separation legs of a wearer, and having an upper reinforcement band and a lower fastening for connecting to a foot fluke fin.

Another object of the invention is the provision of a leg sheath with a cushion overlying achilles tendon areas above rearward heel areas of wearers for streamlining flow over the leg sheath.

Another object of the invention is the provision of a jacket for use with the apparatus, a jacket having a lower fastening means for connecting to the leg sheath, and having an upper neck encircling fastening means for connecting to a helmet, and having overlapping means at wrists for connecting to hand fins.

Another object of the invention is the provision of hand fins for use with the present apparatus, the hand fins having first and second layers of flexible slick skin and having a circular outline blade with palm and finger receiving areas positioned between the layers of skin and extending outward from finger tip areas.

Another object of the invention is the provision of a hand fin for use with the present swimming apparatus, which hand fin has first and second layers of slick skin of a generally quarter circular outline with palm and finger receiving pockets and forming web means between spread finger receiving pockets, which include thumb receiving pockets.

Another object of the invention is providing a helmet apparatus for use with the present swimming apparatus, the helmet comprising a generally annular cushion surrounding a neck area for forming a stream line curve between the lower skull and shoulders of a wearer, and having snorkel tubes extending through the annular cushion from a rearward blow-hole to a forward mouthpiece overlying a mouth area of a wearer.

Another object of the invention is the provision of a helmet with a water-tight snap opening in front of the mouthpiece.

Another object of the invention is the provision of a helmet with a blow-hole having a upward or forward raised lip for promoting eddy currents to maintain air in snorkel tubes leading away from the blow-hole.

Another object of the invention is the provision of a helmet with seals around eye areas and goggles curved vertically and horizontally, and connected to the seals, and with tubes extending from the goggle areas to the mouthpiece for equalization of pressure.

Another object of the invention is the provision of a helmet with goggles comprising lens for correcting distance distortion under water.

Another object of the invention is the provision of a helmet for use with the swimming apparatus of the present invention, the helmet having a mouthpiece with rearward leading tubes and having goggles and seals for surrounding eye areas and having tubes leading from goggles to the mouthpiece for equalization, and having a nose receiving cavity and nostril blocking members at a base of the nose receiving cavity for stopping air passage through a nose.

SUMMARY OF THE INVENTION

The present system is a complete unit designed to enable man to achieve a maximum speed and efficiency under water in relation to the amount of energy consumed. The system was inspired by the study of various cetaceans (whales) and it is hoped that through practice and familiarity in general, man will be able to achieve at least fifty percent efficiency, in relation to body weight and size, of the comparable cetacean.

The system is divided into four parts: the foot fin, the wet suit, the hand fin, and the helmet.

The foot fin is designed after the tail fluke of the cetacean, which distinguishes the cetacean from all other mammals.

The fin is altered for either appearance or efficiency. The basic fin is 27 inches wide by 18 inches long and resembles a tail fluke, except that there is also a swim-flipper boot in which both feet are placed together with a rubber divider between them for protection. The fluke is set at an angle to the boot so as to increase efficiency on the downward and upward movements incorporated in the dolphin kick. The major alteration for more efficiency is the incorporation of aqua-jets in the forward section of the fluke. This gets rid of various eddys which form on the surface of the fin as well as increases the surface area of the fin. Also the outline may be altered at the request of the manufacturer for purposes of appearance or efficiency.

The wet suit is to be made out of synthetic dolphin skin. The fin and mask are to be made out of rubber and treated in such a way as to make the surface shiny. The suit is reinforced at the hips by a strong material or canvas so that there is no slippage when the bottom half is used without the top.

The bottom half of the wet suit is designed to wrap snugly around both legs and close with slide fasteners or hook and loop plastic strips at the front and is constructed to fasten to the fin in a similar manner. The suit connects to the fin at the bottom of the heel and at the top of the arch.

There is a rubber piece which goes between the legs for protection and comfort. The rubber piece may be altered for more comfort in swimming, depending on the build of the swimmer. Also there is a rubber form which goes behind the achilles tendons to give form to the suit and cut down resistance to the water.

The top of the wet suit is specially cut so that the seams give maximum movement to the swimmer and minimum resistance to the water. The suit closes in the front in the same manner as does the bottom and is worn snug. The neck is circular in the area of the collarbone. The top portion of the suit ends around the hips, where it secures to the bottom half reinforcement band with hook and loop plastic strips. The hooks are inside the lower edge of the top half and the loops are on the bottom half. The suit may have comfort slide fasteners on the forearm for easy entry.

The hand fin consists of two pieces of synthetic dolphin skin with an optional fiberglass reinforcement between for support. The fin is cut so that it forms around a spread hand and closes around the wrist. The jacket fits over the wrist area. The general outline of the fin is circular, and the fin extends approximately two inches past the finger tips. A smaller non-reinforced hand fin may be used for dexterity, and although not as efficient, the web between the fingers gives the swimmer some leverage to use against the foot fin, but still allows him to grasp objects.

The helmet consists of two parts which combine to make one unit.

The face mask portion consists of a contoured face plate of shiny rubber in which are secured a mouthpiece and goggles. The mouthpiece has a 1 inch inside diameter to enable fast unobstructed breathing and conforms to a open mouth of about 1 inch diameter. On the forward part of the mouthpiece there is a manual opening with a water-tight snap covering of 1 inch diameter to allow emergency breathing and oral communication on the surface.

A snorkel within the helmet has two tubes which go around the neck and which converge forwardly at the mouthpiece and rearwardly at a blowhole. The air tubes of the snorkel are approximately ¼ inch inside diameter and coverge rearwardly on a blowhole of about 1⅛ inches inside diameter.

The construction of the blowhole is such that water flow over the raised forward part of the hole is disturbed to such an extent that the eddy formed holds the air inside the blowhole and as such does not allow water inside. This function cuts down on the exertion the swimmer has to provide when blowing water out of the snorkel, thus providing a more efficient breathing process.

The goggles are constructed out of approximately 1/16 inch rigid tough glass-like finished plastic or any other glass or plastic material which allows for lens curvature and tempering.

The lenses are curved vertically and horizontally to allow for the refraction of light through the different media so that distance and sizes are perceived as if the swimmer were in the air. The horizontal curvature is continued to allow the lense to wrap around the face and allow for peripherial vision. On the side there may or may not be vertical curvature.

The lenses are mounted so that the bottom is further away from the face than the top. This allows for a more forward field of vision without the movement of the head. The mounting is also such that the lenses are as flush with the face as reasonable so that there is little or no resistance to the water.

The lenses are glued into the frames and there is a seal around the eyes so that there is no leakage of water. There are two tubes of 1/16 inch diameter which connect the goggles directly with the top of mouthpiece. This allows for air pressure equalization in the mask.

The nose is plugged by the mask so that sinus and eustachian tube pressure equalization can be achieved by blowing out the nose without having to reinforce the structure with a hand motion and thus cause water resistance and wasted energy.

The second helmet portion combines with the mask rubber and is made out of synthetic dolphin skin. There is a screened hole over the ears to permit hearing and to allow free flow of pressure. Around the neck of the helmet is a rubber cushion through which the snorkels pass and which is attached to the helmet skin. The blowhole is at the back of the neck. The purpose of the cushion is to shape the neck and top of the shoulders in such a way as to cut down resistance in the form of eddys which are prevalent in that area. The lower part of the helmet attaches in a vee across the chest and back of the suit jacket with hook and loop plastic strips fasteners.

The swimming movement used with the present system is the dolphin stroke. The hands move opposite the hips; the hand fin is used as leverage against the foot fin during dolphin-type kicking. The stroke utilizes the dolphin kick and a sculling motion with the hands. This makes a greater speed accessable for a limited amount of energy consumed. When using just the bottom half of the suit the dolphin kick provides the only propulsion.

The present system is manufactured and sold as a whole unit and as separate parts. The whole unit is particularly useful to oceanariums for instruction and shows, to body surfers, and to skin divers. The bottom half is useful to the same group plus SCUBA divers and kneeboard surfers. The rubber mask when fitted with prescription lenses allows persons to board surf, water ski, springboard dive without having to worry about losing their lenses.

In one modification, the jacket has rubber cushions and more dolphin skin to provide a streamline housing for SCUBA gear to cut down resistance.

These and other objects and features of the invention are apparent in the disclosure which includes the foregoing and ongoing description, the claims and the drawings.

BRIEF DESCRIPTION OF THE DRAWINGS

FIG. 1 is a front elevation of a swimming apparatus constructed according to the present invention.

FIG. 2 is a side elevation of the swimming apparatus shown in FIG. 1.

FIG. 3 is a rear elevation of the swimming apparatus shown in FIGS. 1 and 2.

DETAILED DESCRIPTION OF THE DRAWINGS

Figures 4, 5, 6, 7, 8, 9, 10, 11, 12, 13, 14, 15:
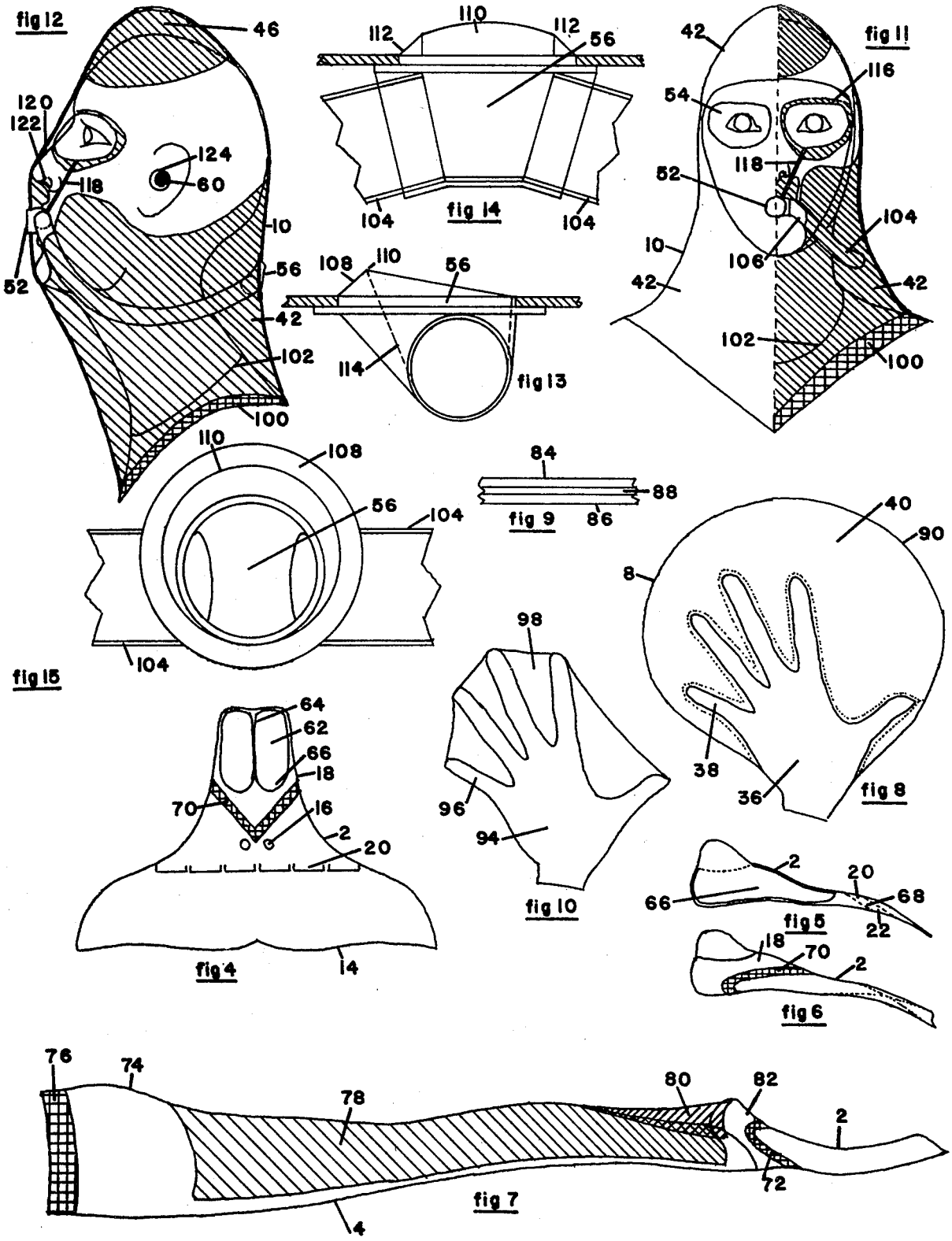
FIG. 4 is a front elevation of a foot fluke fin used with the present swimming apparatus.
FIG. 5 is a sectional view of the fluke shown in FIG. 4.
FIG. 6 is a side elevation of the fluke shown in FIG. 4, further illustrating the fastening means for connecting the fluke to a leg sheath.
FIG. 7 is a detail of a leg sheath used with the present invention.
FIG. 8 is a elevational detail of a hand fin used with the swimming apparatus of the present invention.
FIG. 9 is a detail of layering of elements in the hand fin of FIG. 8.
FIG. 10 is a detail of an alternate form of hand fin used with the present invention.
FIG. 11 is a detail of an helmet used with the present invention.
FIG. 12 is a side view of the helmet shown in FIG. 11.
FIG. 13 is a detail of the blow-hole and snorkel tube shown in FIG. 12.
FIG. 14 is a detail of the blow-hole and snorkel tubes taken from a different angle.
FIG. 15 is a top view detail of the blow-hole and snorkel tubes in the helmet of the present swimming apparatus.

Referring to FIG. 1, swimming apparatus is generally indicated by the numeral 1. The apparatus comprises a foot fluke fin 2, a leg sheath 4, a jacket portion 6, hand fin portions 8, and a helmet 10.

The foot fluke portion 2 has a broad, laterally extended fluke 12, with a distal edge 14. Holes 16 let water out of foot pockets in the foot-receiving portion 18. Port openings 20 connect diagonal passageways with lower rearward ports 22 as shown in FIG. 3.

The leg-receiving sheath has a front longitudinal opening 24, which may be fastened after legs are placed in the sheath.

The jacket portion 6 has a waist 26 which overlies a waist portion of the leg-receiving sheath 4, and has a front opening 28 with a slide-type fastener or with a micro hook-and-loop fastener apparatus. Arms 30 of the jacket portion 6 terminate outwardly in overlapping portions 32 which cover wrist portions of hand fins 8.

The hand fins 8 have wrist areas 34 which underlie the overlying portions 32 of jacket sleeves 30 and have palm areas and finger areas 36 and 38, respectively. A blade 40 extends outwardly from the palm and finger areas and terminates outwardly in a curved outer edge.

Helmet 10 has a neck area 42 which is cushioned to provide a streamlined configuration between a head of a wearer and shoulders. A lower peripheral area 44 has underlying fastening means which cooperate with complementary fasteners on the jacket portion 6 to insure a smooth flow over the suit. The helmet 10 has a cushioned and shaped cap or nose portion 46. Portions 42 and 46 are joined rearwardly. In a preferred construction, the head piece has a separate face plate 50 in which a mouthpiece, nose cavity and goggles are secured. The mouthpiece has a cap 52 which snaps open for communications and forward breathing. Goggles 54 are surrounded by seals and are joined to the mouthpiece by tubes which permit pressure equalization.

The mouthpiece is connected through snorkel tubes to a blow-hole 56 shown in FIGS. 2 and 3. The blowhole is mounted at the back of the neck encircling area 42 just below the head back covering portion 58 of the helmet. Ear openings 60 as shown in FIG. 2 are provided with screens which permit pressure equalization and hearing while preventing injury to the ears.

The entire swimming apparatus shown in FIGS. 1, 2 and 3 is constructed of synthetic dolphin shin which is a soft pliant material having an extremely slippery surface area when wetted.

On sheet 2 of the drawings the foot fluke fin 2 is shown in detail in FIG. 4. The fin has a laterally extended fluke portion 12, which tapers outwardly and terminates in a curved distal edge 14. Foot-receiving pockets 62 are divided centrally by a cushion 64. Openings 66 provide access to the foot-receiving pockets in the foot mounting portion 18. Holes 16 permit flow out of toe areas of pockets 62 when feet are inserted in the pockets. A parallel row of plural port openings 20 leads from an area of the fluke just forward of the toe through diagonal channels 68 to rearward ports 22 as seen with reference to FIGS. 5 and 2.

As shown in FIGS. 4 and 6, a fastening means 70 constructed from micro hoop-and-loop type fasteners surrounds the foot portion 18 of the foot fluke fin 2.

Referring to FIG. 7, the fastening means on the foot fin has a complementary inward facing fastening means 72 around a lower edge of a leg-receiving sheath 4. The leg-receiving sheath 4 has a hip-receiving portion 74 which is topped by a reinforced waist band 76 which is also provided with external fastening means preferably of the micro hook-and-loop type.

A central cushion 78 divides the leg-receiving areas of the leg-receiving sheath, and separates and cushions the legs. An achilles tendon cushion 80 covers the rearward lower leg areas of a wearer above a heel and streamlines the line of the leg-receiving sheath 40. The lower portion 82 of the leg-receiving sheath surrounds the instep and heel portion of the foot fluke fin 2.

With reference to FIG. 8 and FIG. 9, it may be seen that the hand fin 8 is constructed of two layers 84 and 86 of synthetic dolphin skin with an intermediate rigid plate 88 which forms a fin 40 having a curve substantially circular out edge 90. Finger receiving cavities 38 extend outward from a palm receiving cavity 36 which is formed between the layers of dolphin skin. The finger receiving cavity 38 include a cavity for the thumb as shown in the drawing. In a preferred embodiment, plate 88 is formed with a hand, palm and finger receiving recesses.

An alternate hand fin is shown in FIG. 10. A sheath formed of one or two layers of dolphin skin has a wrist area 92 and palm and finger areas 94 and 96, which are joined by webs 98 extending between finger and thumb receiving areas 96 and extending outward to tips of the digits.

With reference to FIGS. 11 and 12, the helmet 10 has a neck area 42 formed of an annular shaped cushion which surrounds the neck of a wearer and which streamlines the configuration of the entire suit from head to shoulders. Helmet 10 has a bottom fastening 100 means on an underside of the helmet around an edge to cooperate with a complementary fastening means on the jacket portions 6 to hold the helmet and jacket tightly assemblied. In a preferred form, the fastening means between the helmet and the jacket are constructed of micro loop-and-hook type fasteners.

An upper neck 102 of jacket 6 is shown in FIGS. 11 and 12.

Snorkel tubes 104 extend rearward from mouthpiece 106 to a snorkel 56 mounted exteriorly on a rear surface of the neck encircling portion 42 of helmet 10. In a preferred embodiment such as shown in FIGS. 14 and 15, two snorkel tubes are employed and the snorkel tubes 104 join at the mouthpiece 106 and at the blow-hole 56. In the preferred embodiment shown in FIGS. 12–15, the blow-hole has a smooth leading edge 108 which leads upward to an apex 110 at the forward or upward edge of the blow-hole. This forward apex 110 and the sloping forward wall 108 and sloping side walls 112 create eddy currents around the blow-hole which keep the interior cavity 114 of the blow-hole free of water.

The sloping interior walls of cavity 114 are best shown in FIGS. 13, 14 and 15.

As best shown in FIG. 11, the cap portion 46 and neck portion 42 of the helmet 10 are joined in a single section. A face plate which is held tightly against the face by the large helmet portion includes the mouthpiece 106 and goggles 54 which are surrounded by seals 116. The seals lie tightly against the face of the wearer, and the sealed area around the goggles is communicated with the mouthpiece by small tubes 118, which equalize pressure in the goggles.

In nose cavity 120 as best shown in FIG. 12 is provided with nostril blocking members 122 to prevent air flow from the nostrils so that the helmet may be equalized by blowing outward through the mouth. Cap 52 which opens the mouthpiece forwardly, and which closes in a water tight seal is shown in both FIGS. 11 and 12.

The ear openings 60 which permits hearing and pressure equalization is provided with a screen 124 to prevent objects from entering the cavity.

Although the invention has been described with reference to specific embodiments, it will be obvious to those skilled in the art that variations and modifications may be constructed without departing from the spirit and scope of the invention. The scope of the invention is defined in the following claims.

I claim:

1. Swimming apparatus comprising a helmet, viewing means in the front portion of said helmet adapted to lie over the eyes of a swimmer the helmet having an annular cushion means generally surrounding a neck area of the helmet for forming a streamlined curve between a top of a head and shoulders of the wearer, the helmet further defining a blow-hole in a rearward portion of the helmet, a mouthpiece mounted on the front portion of the helmet below said viewing means and adapted to cover the mouth area of a swimmer, snorkel tube means leading forward from the blow-hole forward through the annular cushion to the mouthpiece, the snorkel tube means having a first open end connected to the blow-hole and a second open end connected to the mouthpiece and a neck surrounding fastening means being connected to a lower surface of the helmet.

2. The swimming apparatus of claim 1, wherein the blow-hole comprises an opening in the rearward surface of the helmet with a raised forward edge portion around the opening in the direction toward the top of a head portion of the helmet, whereby eddy currents are formed around the blow-hole for insuring and promoting air communication with the blow-hole, and for preventing filling of the snorkel tubes with water.

3. The swimming apparatus of claim 1, further comprising an opening in said mouthpiece communicating with the surrounding atmosphere, a water-tight snap seal over said opening whereby the wearer may breathe forwardly and may orally communicate through the opening.

4. The swimming apparatus of claim 1, wherein said viewing means comprises goggles having sealing means extending around an area which corresponds with an eye area of a wearer, and having lens means fitted on the sealing means and being formed with vertical and lateral curvatures for promoting correct vision underwater, and further having tubes leading from areas within the seals to the mouthpiece for equalizing pressures in the lens area, and wherein the helmet further has a blockage beneath a nose cavity for stopping nose passages whereby blowing through the mouth pressurizes an interior of the helmet.

5. The swimming apparatus of claim 1, further comprising a jacket portion, the jacket portion having a body trunk portion with a waist opening and with a head opening connected to the neck fastening means on the helmet, and with a jacket opening fastenings means extending from the head opening to the waist opening, and having arm portions terminating outwardly in overlapping means.

6. The swimming apparatus of claim 5, further comprising hand fin means having a wrist band portion for underlying the overlapping portion, and having first and second slick skin layers for respectively overlying and underlying hand, palm and finger portions, and further comprising a fiberglass reinforcement blade having a generally circular confirmation mounted medially at edges of the first and second slick skin portions, and extending outward therefrom.

7. The swimming apparatus of claim 5, further comprising a hand covering having a wrist portion for underlying the overlapping portion, and having a hand covering extending outward from the wrist portion, the hand covering having a palm portion and having separate finger covering portions, and a flexible web means extending between the finger portions and terminating outwardly adjacent tips of the finger portions.

8. The apparatus of claim 5, further comprising an upper fastening means encircling the neck opening of the jacket portion, and generally overlying the shoulders and back of the jacket portion, and dipping downward in front of the neck opening, a second complementary neck surrounding fastening means for connecting to the upper fastening means, the second complementary neck surrounding fastening means being connected to a lower surface of a helmet.

9. The swimming apparatus of claim 5, further comprising a leg receiving sheath having a waist opening, a reinforcement band mounted about the periphery of said waist band of said leg sheath, a first waist fastening means mounted exteriorly on the reinforcement band of the leg sheath, and a second complementary fastening means mounted interiorly on a lower edge of the jacket portion and fastened to said first waist fastening means.

10. The apparatus of claim 9, further comprising a foot fin first fastening means on the fin and second fastening means, the second fastening means being mounted along an inner surface of a lower edge of a leg receiving sheath, the leg receiving sheath comprising a slick skin having a longitudinal opening for inserting legs, and having a leg divider centrally longitudinally mounted on an interior of the skin for cushioning and separating legs, the leg receiving sheath having a hip receiving portion and having an upper reinforcement band surrounding an upper edge of the hip receiving portion.

11. The swimming apparatus of claim 10, further comprising first fastening means mounted on the fin and encircling and surrounding the fin in a substantially continuous line passing from a forward point on a center of an upper surface of the fin, rearward and downward over a toe area of both foot-receiving pockets and downward around an underside of the fin in an area corresponding to a instep area of the foot-receiving pocket, so that the fastener is forward of a heel portion of the foot-receiving pockets.

12. The swimming apparatus of claim 9, wherein the leg receiving sheath further comprises a generally triangular shaped cushion having a smooth outward streamline configuration mounted in a lower rearward portion of the sheath for cushioning the legs and streamlining the sheath in the portion of the sheath configured for overlying achilles tendons above rearward heel areas of a wearer.

* * * * *